US008960998B2

(12) United States Patent
Ringgenberg et al.

(10) Patent No.: US 8,960,998 B2
(45) Date of Patent: Feb. 24, 2015

(54) SYSTEM AND METHOD OF MIXING A FORMATION FLUID SAMPLE IN A DOWNHOLE SAMPLING CHAMBER WITH A MAGNETIC MIXING ELEMENT

(71) Applicant: Halliburton Energy Services, Inc., Houston, TX (US)

(72) Inventors: Paul David Ringgenberg, Frisco, TX (US); Paul I. Herman, Plano, TX (US); Vincent Paul Zeller, Flower Mound, TX (US); Donald H. Perkins, Allen, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/834,027

(22) Filed: Mar. 15, 2013

(65) Prior Publication Data

US 2013/0315024 A1 Nov. 28, 2013

(51) Int. Cl.
*B01F 13/08* (2006.01)

(52) U.S. Cl.
CPC ..... *B01F 13/08* (2013.01)
USPC ..... 366/144; 366/273; 166/264

(58) Field of Classification Search
CPC ..... B01F 13/08; B01F 13/0818
USPC ..... 366/273–274, 108–128, 144–146, 366/332–333; 416/3; 417/420; 435/302.1; 166/264
See application file for complete search history.

(56) References Cited

U.S. PATENT DOCUMENTS

| | | | | | |
|---|---|---|---|---|---|
| 3,514,214 | A * | 5/1970 | Vogtle et al. | ..... | 416/3 |
| 3,554,497 | A * | 1/1971 | Zipperer | ..... | 366/110 |
| 3,591,309 | A * | 7/1971 | Ray et al. | ..... | 416/3 |
| 3,595,531 | A * | 7/1971 | Williams et al. | ..... | 366/273 |
| D226,346 | S * | 2/1973 | Newman | ..... | D7/412 |
| 5,176,446 | A * | 1/1993 | Chiba et al. | ..... | 366/114 |
| 5,227,138 | A * | 7/1993 | Boyd et al. | ..... | 422/549 |
| 5,529,391 | A * | 6/1996 | Kindman et al. | ..... | 366/145 |
| 5,911,503 | A * | 6/1999 | Braden et al. | ..... | 366/143 |
| 6,382,827 | B1 * | 5/2002 | Gebrian | ..... | 366/274 |
| 6,467,946 | B1 * | 10/2002 | Gebrian | ..... | 366/273 |
| 7,407,631 | B2 * | 8/2008 | Swon et al. | ..... | 422/561 |
| 7,614,294 | B2 | 11/2009 | Hegeman et al. | | |
| 7,621,325 | B2 * | 11/2009 | Shammai et al. | ..... | 166/264 |
| 7,775,961 | B2 | 8/2010 | Meikrantz | | |

(Continued)

FOREIGN PATENT DOCUMENTS

| | | | | |
|---|---|---|---|---|
| JP | 63190627 A * | 8/1988 | ..... | B01F 13/08 |
| RU | 2198021 C1 * | 2/2003 | | |
| WO | 2009009144 | 1/2009 | | |

OTHER PUBLICATIONS

International Search Report and Written Opinion, PCT/US2012/039760, KIPO, Feb. 21, 2013.

*Primary Examiner* — Charles Cooley
(74) *Attorney, Agent, or Firm* — Haynes and Boone, LLP

(57) ABSTRACT

A system for mixing a formation fluid sample obtained in a downhole sampling chamber. The system includes a mixing element disposed in the downhole sampling chamber. A support stand is operable to receive the downhole sampling chamber. A magnetic field generator is operably associated with the downhole sampling chamber such that when the magnetic field generator generates a magnetic field, the mixing element moves through the formation fluid sample responsive to the magnetic field, thereby mixing the formation fluid sample.

17 Claims, 6 Drawing Sheets

(56) References Cited

U.S. PATENT DOCUMENTS

| | | | | |
|---|---|---|---|---|
| 7,946,166 | B2 * | 5/2011 | Irani et al. | 73/152.23 |
| 8,122,956 | B2 * | 2/2012 | Shammai et al. | 166/264 |
| 8,814,421 | B2 * | 8/2014 | Ringgenberg | 366/144 |
| 2005/0238540 | A1 * | 10/2005 | Swon et al. | 422/99 |
| 2006/0209628 | A1 * | 9/2006 | Jones et al. | 366/273 |
| 2010/0000731 | A1 * | 1/2010 | Gordon et al. | 166/264 |
| 2011/0174068 | A1 * | 7/2011 | Irani et al. | 73/152.23 |
| 2011/0308391 | A1 | 12/2011 | Degreeve et al. | |
| 2013/0315024 | A1 * | 11/2013 | Ringgenberg et al. | 366/108 |
| 2013/0315027 | A1 * | 11/2013 | Ringgenberg | 366/144 |

* cited by examiner

SYSTEM AND METHOD OF MIXING A FORMATION FLUID SAMPLE IN A DOWNHOLE SAMPLING CHAMBER WITH A MAGNETIC MIXING ELEMENT

CROSS-REFERENCE TO RELATED APPLICATIONS

This application claims the benefit under 35 U.S.C. §119 of the filing date of International Application No. PCT/US2012/039760, filed May 25, 2012. The entire disclosure of this prior application is incorporated herein by this reference.

TECHNICAL FIELD OF THE INVENTION

This invention relates, in general, to equipment utilized in conjunction with operations performed in subterranean wells and, in particular, to a system and method of mixing a formation fluid sample obtained in a downhole sampling chamber by moving a mixing element through the formation fluid sample responsive to an applied magnetic field.

BACKGROUND OF THE INVENTION

Without limiting the scope of the present invention, its background will be described with reference to downhole testing operations, as an example. It is well known in the subterranean well drilling and completion art to perform tests on formations intersected by a wellbore. Such tests are typically performed in order to determine geological or other physical properties of the formation and the fluid contained therein. For example, parameters such as permeability, porosity, fluid resistivity, temperature, pressure and saturation pressure may be determined. These and other characteristics of the formation and fluid contained therein may be determined by performing tests on the formation before the well is completed.

One type of testing procedure that is commonly performed is obtaining fluid samples from the formation to, among other things, determine the composition of the formation fluid. In this procedure, it is important to obtain samples of the formation fluid that are representative of the fluid, as it exists in the formation. In a typical sampling procedure, samples of the formation fluid may be obtained by lowering a sampling tool having one or more sampling chambers into the wellbore on a conveyance such as a wireline, slick line, coiled tubing, jointed tubing or the like. When the sampling tool reaches the desired depth, one or more ports are opened to allow collection of the formation fluid. The ports may be actuated in variety of ways such as by electrical, hydraulic or mechanical methods. Once the ports are opened, formation fluid enters the sampling tool such that samples of the formation fluid may be obtained within the sampling chambers. After the samples have been collected, the sampling tool may be withdrawn from the wellbore and the formation fluid samples may be analyzed.

It has been found, however, that as the fluid samples are retrieved to the surface, the temperature of the fluid samples may decrease causing shrinkage of the fluid samples and a reduction in the pressure of the fluid samples. These changes can cause the fluid samples to reach or drop below saturation pressure creating the possibility of asphaltene deposition and flashing of entrained gasses present in the fluid samples. Accordingly, once the sampling tool is retrieved to the surface and before the fluid samples are transferred to storage bottles, it is common to place the sampling chambers in a rocking stand, which tilts the sampling chambers up and down in a seesaw fashion to mix the fluid samples. To aid in mixing, heat may be applied to the sampling chambers. In addition, some sampling chambers include internal mixing balls that move through the fluid samples responsive to the force of gravity to aid in the mixing process.

It has been found, however, that mixing fluid samples using rocking stands can be a time consuming and difficult process. In order to achieve the desired mixing, sampling chambers often spend several days or weeks on the rocking stand. In addition, as the sampling chambers are in motion, it is difficult to obtain pressure readings associated with the fluid samples. Further, as the sampling chambers are typically quite long, the space required to perform a rocking operation for numerous sampling chambers is typically not available on the rig floor during offshore operations. Accordingly, a need has arisen for an improved method of mixing a fluid sample obtained in a downhole sampling chamber before the fluid sample is transferred to a storage bottle.

SUMMARY OF THE INVENTION

The present invention disclosed herein is directed to an improved method of mixing a formation fluid sample obtained in a downhole sampling chamber before the formation fluid sample is transferred to a storage bottle. The system and method of the present invention involve moving a mixing element through the formation fluid sample in the downhole sampling chamber responsive to an applied magnetic field.

In one aspect, the present invention is directed to a method of mixing a formation fluid sample in a downhole sampling chamber. The method includes positioning the downhole sampling chamber in a support stand; imposing a magnetic field on a mixing element disposed within the downhole sampling chamber; moving the mixing element through the formation fluid sample responsive to the magnetic field; and mixing the formation fluid sample.

The method may also include longitudinally moving the mixing element through the formation fluid sample, rotating the mixing element in the formation fluid sample, rotating the mixing element in the formation fluid sample responsive to the magnetic field, rotating the mixing element in the formation fluid sample responsive to interaction with the formation fluid sample, heating the formation fluid sample and/or vibrating the downhole sampling chamber.

In another aspect, the present invention is directed to a method of mixing a formation fluid sample in a downhole sampling chamber. The method includes positioning the downhole sampling chamber in a support stand; imposing a magnetic field on a mixing element disposed within the downhole sampling chamber; longitudinally moving the mixing element through the formation fluid sample responsive to the magnetic field; rotating the mixing element in the formation fluid sample; and mixing the formation fluid sample.

In a further aspect, the present invention is directed to a system for mixing a formation fluid sample in a downhole sampling chamber. The system includes a mixing element disposed in the downhole sampling chamber. A support stand is operable to receive the downhole sampling chamber. A magnetic field generator is operably associated with the downhole sampling chamber such that when the magnetic field generator generates a magnetic field, the mixing element moves through the formation fluid sample responsive to the magnetic field, thereby mixing the formation fluid sample.

In one embodiment, a heating element is operably associated with the downhole sampling chamber and is operable to heat the formation fluid sample. In another embodiment, a vibrating assembly is operably associated with the downhole sampling chamber and is operable to vibrate the formation fluid sample. In certain embodiments, the mixing element may be a spherical mixing element. In other embodiments, the mixing element may be a substantially cylindrical mixing element. In some embodiments, the mixing element may have a fluted external surface. In other embodiments, the mixing element may have an internal fluid passageway, which may have a fluted internal surface. In one embodiment, the mixing element may include a plurality of blades.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the invention.

Figure 1:
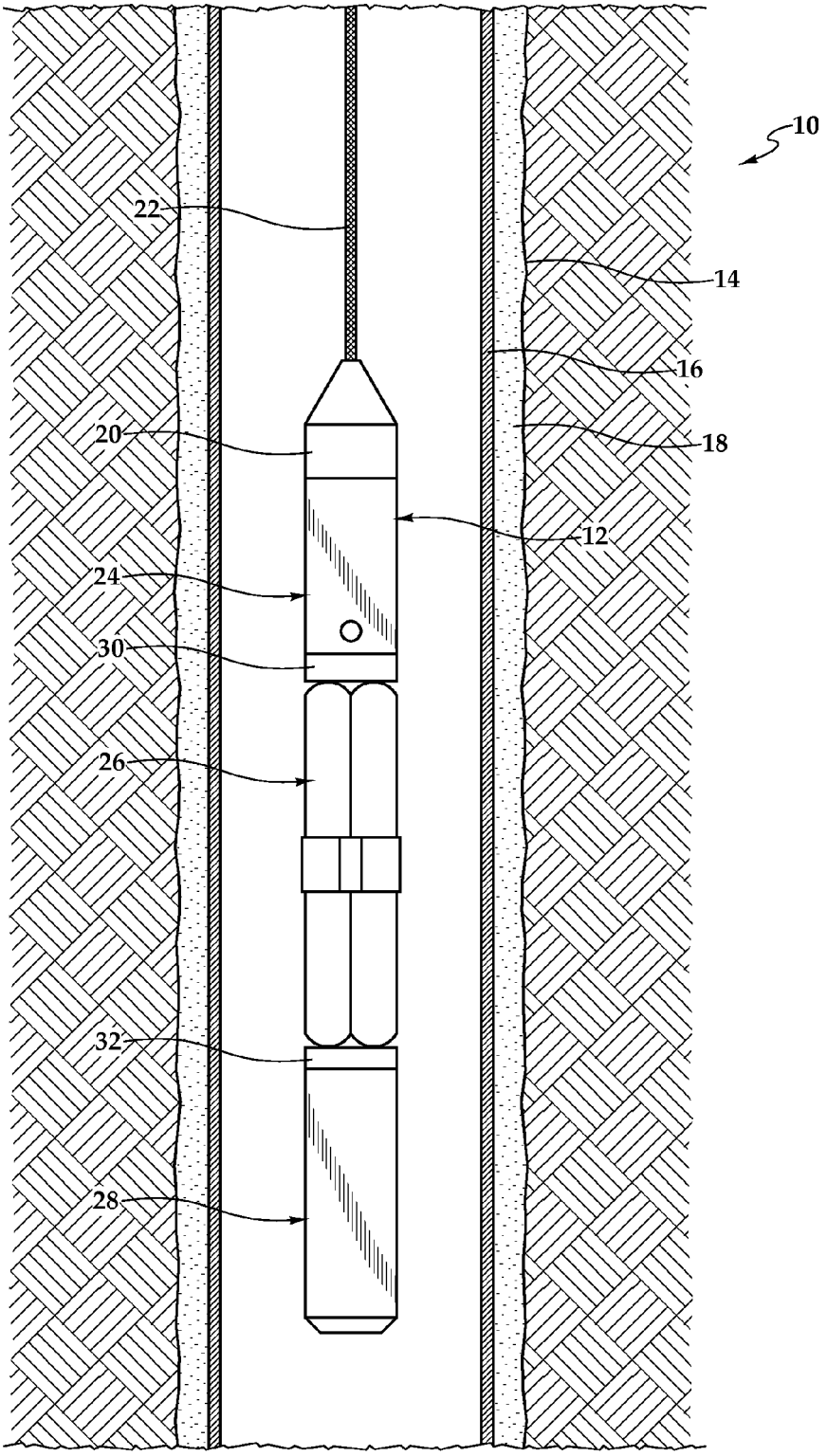
FIG. 1 is a schematic illustration of a fluid sampler system according to an embodiment of the present invention.
Figure 2A:
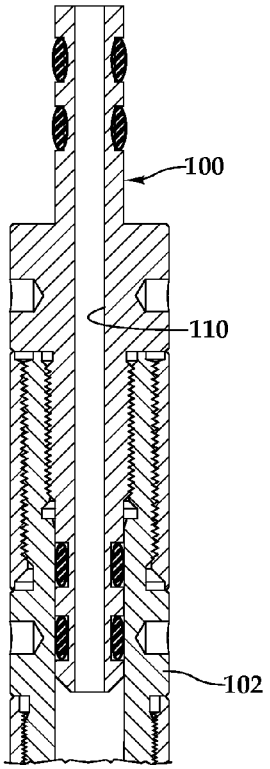
FIGS. 2A-2F are cross-sectional views of successive axial sections of a downhole sampling chamber according to an embodiment of the present invention.
Figure 2B:
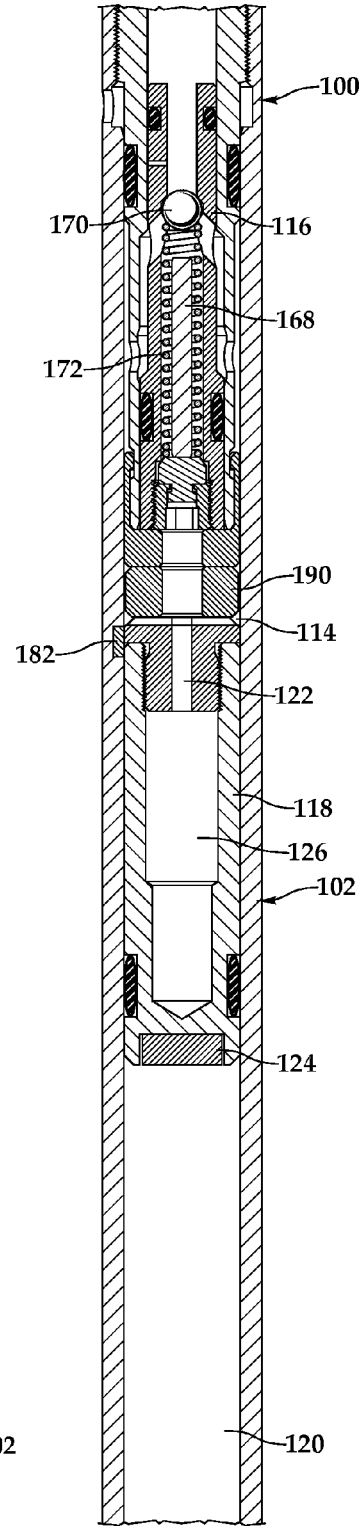
Figure 2C:
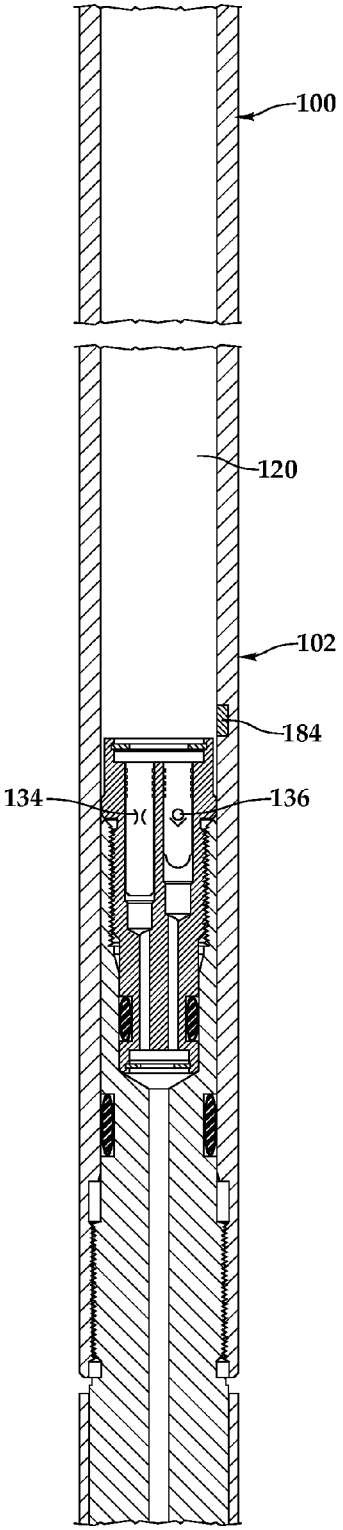
Figure 2D:
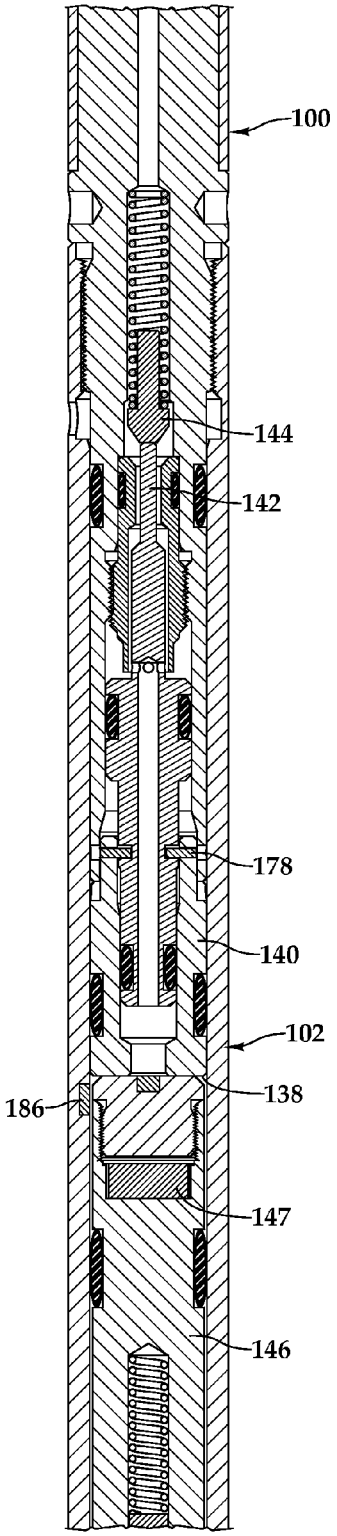
Figure 2E:
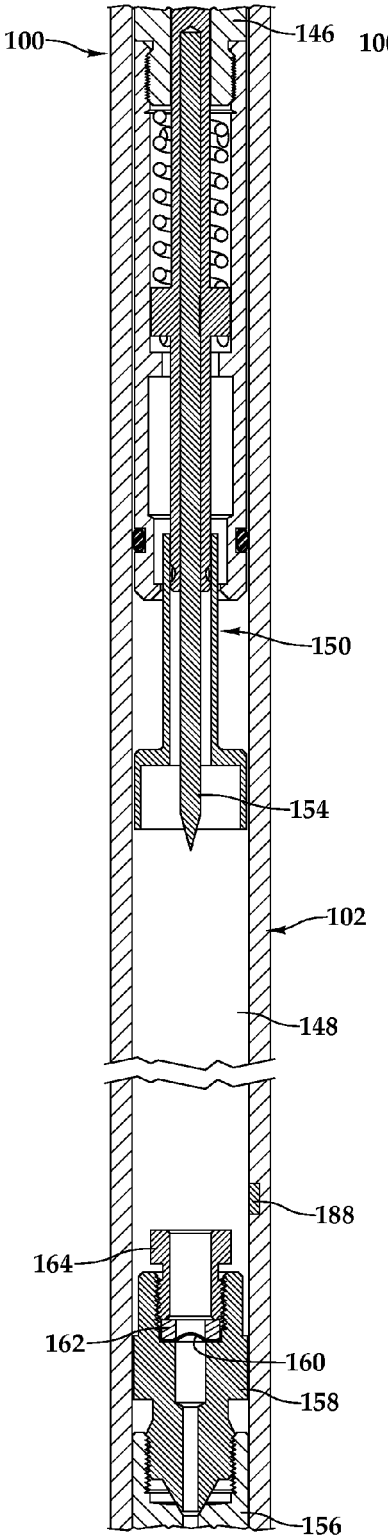
Figure 2F:
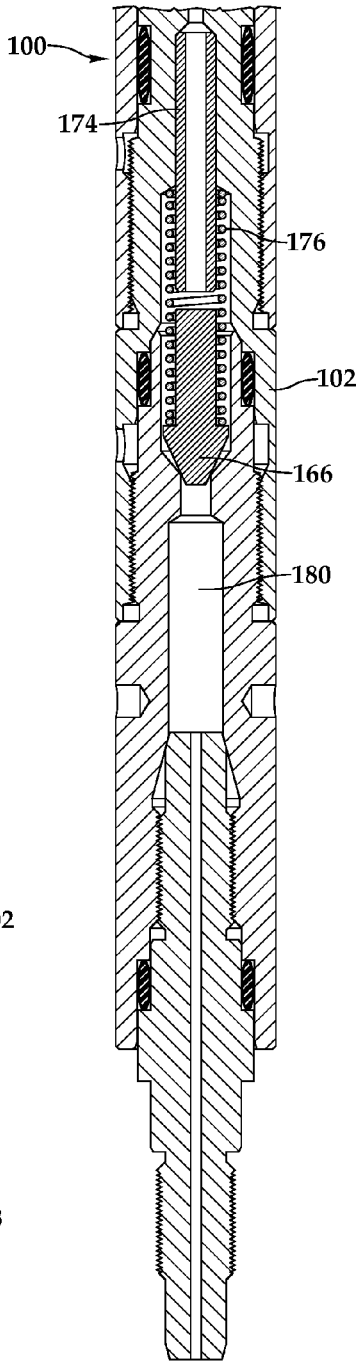

Referring initially to FIG. 1, therein is representatively illustrated a fluid sampler system 10 of the present invention. A fluid sampler 12 is being run in a wellbore 14 that is depicted as having a casing string 16 secured therein with cement 18. Although wellbore 14 is depicted as being cased and cemented, it could alternatively be uncased or open hole. Fluid sampler 12 includes a cable connector 20 that enables fluid sampler 12 to be coupled to or operably associated with a wireline conveyance 22 that is used to run, retrieve and position fluid sampler 12 in wellbore 14. Wireline conveyance 22 may be a single strand or multistrand wire, cable or braided line, which may be referred to as a slickline or may include one or more electric conductors, which may be referred to as an e-line or electric line. Even though fluid sampler 12 is depicted as being connected directly to cable connector 20, those skilled in the art will understand that fluid sampler 12 could alternatively be coupled within a larger tool string that is being positioned within wellbore 14 via wireline conveyance 22 or could be convey via coiled tubing, jointed tubing or the like.

In the illustrated embodiment, fluid sampler 12 includes an actuator assembly 24, a sampler assembly 26 and a self-contained pressure source assembly 28. Preferably, sampler assembly 26 includes multiple sampling chambers, such as two, three or four sampling chambers. In coiled tubing or jointed tubing conveyed embodiments, sampler assembly 26 may include nine or more sampling chambers. In order to route the fluid samples into the desired sampling chamber, fluid sampler 12 includes a manifold assembly 30 positioned between actuator assembly 24 and sampler assembly 26. Valving or other fluid flow control circuitry within manifold assembly 30 may be used to enable fluid samples to be taken in all of the sampling chambers simultaneously or to allow fluid samples to be sequentially taken into the various sampling chambers. In slickline conveyed embodiments, actuator assembly 24 preferably includes timing circuitry such as a mechanical or electrical clock, which is used to determine when the fluid sample or samples will be taken. Alternatively, a pressure signal or other wireless input signal could be used to initiate operation of actuator assembly 24. In electric line conveyed embodiments, actuator assembly 24 preferably includes electrical circuitry operable to communicate with surface systems via the electric line to initiate operation of actuator assembly 24.

After the fluid samples are taken, in order to route pressure into the desired sampling chamber, fluid sampler 12 includes a manifold assembly 32 positioned between sampler assembly 26 and self-contained pressure source 28. Self-contained pressure source 28 may include one or more pressure chambers that initially contain a pressurized fluid, such as a compressed gas or liquid, and preferably contain compressed nitrogen at between about 10,000 psi and 20,000 psi. Those skilled in the art will understand that other fluids or combinations of fluids and/or other pressures both higher and lower could be used, if desired. Depending on the number of sampling chambers and the number of pressure chambers, valving or other fluid flow control circuitry within manifold assembly 32 may be operated such that self-contained pressure source 28 serves as a common pressure source to simultaneously pressurize all sampling chambers or may be operated such that self-contained pressure source 28 independently pressurizes certain sampling chambers sequentially. In the case of multiple sampling chambers and multiple pressure chambers, manifold assembly 32 may be operated such that pressure from certain pressure chambers of self-contained pressure source 28 is routed to certain sampling chambers.

Referring now to FIGS. 2A-2F a downhole fluid sampling chamber for use in a fluid sampler that embodies principles of the present invention is representatively illustrated and generally designated 100. Preferably, one or more of sampling chambers 100 are positioned in a sampler assembly 26 that is coupled to an actuator assembly 24 and a self-contained pressure source assembly 28 as described above. As described more fully below, a passage 110 in an upper portion of sampling chamber 100 (see FIG. 2A) is placed in communication with the exterior of fluid sampler 10 when the fluid sampling operation is initiated. Passage 110 is in communication with a sample chamber 114 via a check valve 116. Check valve 116 permits fluid to flow from passage 110 into sample chamber 114, but prevents fluid from escaping from sample chamber 114 to passage 110.

A debris trap piston 118 is disposed within housing assembly 102 and separates sample chamber 114 from a meter fluid chamber 120. When a fluid sample is received in sample chamber 114, debris trap piston 118 is displaced downwardly relative to housing assembly 102 to expand sample chamber 114. Prior to such downward displacement of debris trap piston 118, however, fluid flows through sample chamber 114 and passageway 122 of piston 118 into debris chamber 126 of debris trap piston 118. The fluid received in debris chamber 126 is prevented from escaping back into sample chamber 114 due to the relative cross sectional areas of passageway 122 and debris chamber 126 as well as the pressure maintained on debris chamber 126 from sample chamber 114 via passageway 122. An optional check valve (not pictured) may be disposed within passageway 122 if desired. In this manner, the fluid initially received into sample chamber 114 is trapped in debris chamber 126. Debris chamber 126 thus permits this initially received fluid to be isolated from the fluid sample later received in sample chamber 114. Debris trap piston 118 includes a magnetic locator 124 used as a reference to determine the level of displacement of debris trap piston 118 and thus the volume within sample chamber 114 after a sample has been obtained.

Meter fluid chamber 120 initially contains a metering fluid, such as a hydraulic fluid, silicone oil or the like. A flow restrictor 134 and a check valve 136 control flow between chamber 120 and an atmospheric chamber 138 that initially contains a gas at a relatively low pressure such as air at atmospheric pressure. A collapsible piston assembly 140 includes a prong 142, which initially maintains check valve 144 off seat, so that flow in both directions is permitted through check valve 144 between chambers 120, 138. When elevated pressure is applied to chamber 138, however, as described more fully below, piston assembly 140 collapses axially, and prong 142 will no longer maintain check valve 144 off seat, thereby preventing flow from chamber 120 to chamber 138.

A piston 146 disposed within housing 102 separates chamber 138 from a longitudinally extending atmospheric chamber 148 that initially contains a gas at a relatively low pressure such as air at atmospheric pressure. Piston 146 includes a magnetic locator 147 used as a reference to determine the level of displacement of piston 146 and thus the volume within chamber 138 after a sample has been obtained. Piston 146 included a piercing assembly 150 at its lower end. In the illustrated embodiment, piercing assembly 150 is spring mounted within piston 146 and includes a needle 154. Needle 154 has a sharp point at its lower end and may have a smooth outer surface or may have an outer surface that is fluted, channeled, knurled or otherwise irregular. As discussed more fully below, needle 154 is used to actuate the pressure delivery subsystem of the fluid sampler when piston 146 is sufficiently displaced relative to housing assembly 102.

Below atmospheric chamber 148 and disposed within the longitudinal passageway of housing assembly 102 is a valving assembly 156. Valving assembly 156 includes a pressure disk holder 158 that receives a pressure disk therein that is depicted as rupture disk 160, however, other types of pressure disks that provide a seal, such as a metal-to-metal seal, with pressure disk holder 158 could also be used including a pressure membrane or other piercable member. Rupture disk 160 is held within pressure disk holder 158 by hold down ring 162 and gland 164 that is threadably coupled to pressure disk holder 158. Valving assembly 156 also includes a check valve 166. Valving assembly 156 initially prevents communication between chamber 148 and a passage 180 in a lower portion of sampling chamber 100. After actuation of the pressure delivery subsystem by needle 154, check valve 166 permits fluid flow from passage 180 to chamber 148, but prevents fluid flow from chamber 148 to passage 180. Preferably, passageway 180 is placed in fluid communication with pressure from the self-contained pressure source via the manifold therebetween.

In the illustrated embodiment, sampling chamber 100 includes a plurality of internal sensors 182, 184, 186, 188. Specifically, internal sensor 182 is positioned in sample chamber 114. Internal sensor 184 is positioned in metering fluid chamber 120. Internal sensor 186 is positioned in atmospheric chamber 138. Internal sensor 188 is positioned in atmospheric chamber 148. As illustrated, internal sensors 182, 184, 186, 188 are positioned in the various pressure regions of sampling chamber 100. Upon retrieval to the surface and the during the mixing operation, internal sensors 182, 184, 186, 188 may be periodically interrogated by a data acquisition device to determine the current pressures in the various pressure regions. For example, the data acquisition device may communicate with internal sensors 182, 184, 186, 188 using radio frequency electromagnetic fields or other wireless communication means.

In the illustrated embodiment, sampling chamber 100 includes a mixing element 190 disposed within sample chamber 114. Mixing element 190 is preferable formed from a metal, such as steel, that is responsive to a magnetic field. Specifically, after sampling chamber 100 has been retrieved to the surface and positioned in a support stand, a magnetic field is imposed on mixing element 190 such that mixing element 190 is moved through the formation fluid sample, thereby mixing the formation fluid sample in sample chamber 114. The magnetic field may move mixing element 190 longitudinally through the formation fluid sample, rotationally in the formation fluid sample or both. Preferably, mixing element 190 has a relatively close fitting relationship with the inner surface of sample chamber 114 such that mixing element 190 remains adjacent to check valve 116 during fluid sample acquisition.

In operation, once the fluid sampler has been run downhole via the wireline conveyance to the desired location and is in its operable configuration, a fluid sample can be obtained into one or more of the sample chambers 114 by operating the actuator. Fluid enters passage 110 in the upper portion of each of the desired sampling chambers 100. For clarity, the operation of only one of the sampling chambers 100 after receipt of a fluid sample therein is described below. The fluid sample flows from passage 110 through check valve 116 to sample chamber 114. It is noted that check valve 116 may include a restrictor pin 168 to prevent excessive travel of ball member 170 and over compression or recoil of spiral wound compression spring 172. An initial volume of the fluid sample is trapped in debris chamber 126 of piston 118 as described above. Downward displacement of piston 118 is slowed by the metering fluid in chamber 120 flowing through restrictor 134. This prevents pressure in the fluid sample received in sample chamber 114 from dropping below its saturation pressure.

As piston 118 displaces downward, the metering fluid in chamber 120 flows through restrictor 134 into chamber 138. At this point, prong 142 maintains check valve 144 off seat.

The metering fluid received in chamber 138 causes piston 146 to displace downwardly. Eventually, needle 154 pierces rupture disk 160, which actuates valving assembly 156. Actuation of valving assembly 156 permits pressure from the self-contained pressure source to be applied to chamber 148. Specifically, once rupture disk 160 is pierced, the pressure from the self-contained pressure source passes through passage 180 and valving assembly 156 including moving check valve 166 off seat. In the illustrated embodiment, a restrictor pin 174 prevents excessive travel of check valve 166 and over compression or recoil of spiral wound compression spring 176. Pressurization of chamber 148 also results in pressure being applied to chambers 138, 120 and thus to sample chamber 114.

When the pressure from the self-contained pressure source is applied to chamber 138, pins 178 are sheared allowing piston assembly 140 to collapse such that prong 142 no longer maintains check valve 144 off seat. Check valve 144 then prevents pressure from escaping from chamber 120 and sample chamber 114. Check valve 116 also prevents escape of pressure from sample chamber 114. In this manner, the fluid sample received in sample chamber 114 is pressurized such that the fluid sample may be retrieved to the surface without degradation by maintaining the pressure of the fluid sample above its saturation pressure, thereby obtaining a fluid sample that is representative of the fluids present in the formation.

Figure 3:
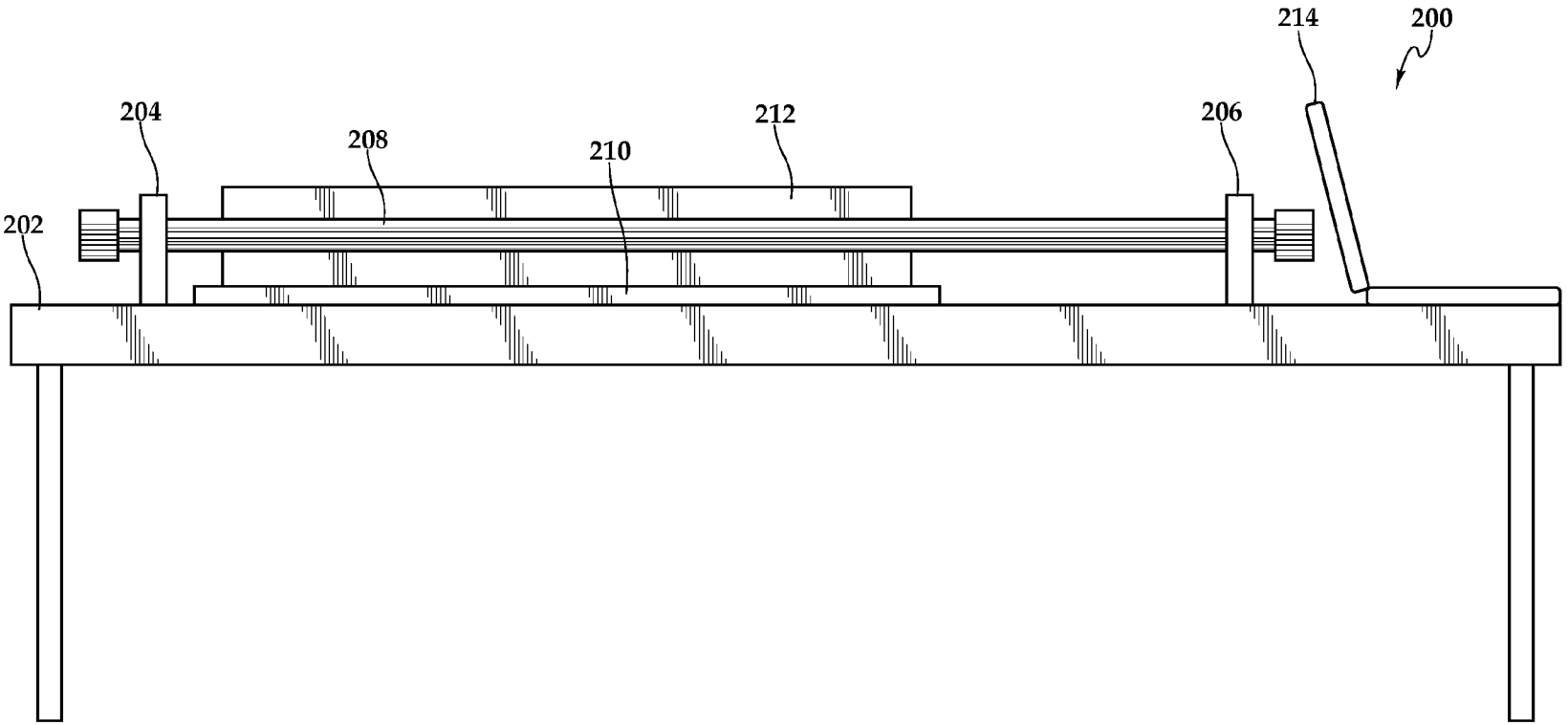
FIG. 3 is a side view of a support stand for mixing a formation fluid sample obtained in a downhole sampling chamber according to an embodiment of the present invention.

Referring next to FIG. 3, therein is depicted a support stand for mixing a formation fluid sample obtained in a downhole sampling chamber that is generally designated 200. In the illustrated embodiment, support stand 200 is depicted as a table 202 that may be located on the rig floor of an offshore platform or other location. Table 202 may be configured to support a single mixing station or multiple mixing stations. As illustrated, table 202 includes a pair of sampling chamber receivers 204, 206 operable to receive a downhole sampling chamber 208 therein. At least one of sampling chamber receivers 204, 206 may optionally be operable to vibrate downhole sampling chamber 208 such as by high frequency vibration, including ultrasonic vibration, during a mixing operation. Alternatively, a vibrating assembly independent of sampling chamber receivers 204, 206 may be used to optionally vibrate downhole sampling chamber 208 during a mixing operation, if desired. Table 202 also supports one or more heating elements 210 that may be used to optionally heat downhole sampling chamber 208 during a mixing operation.

A magnetic field generator 212 is positioned on table 202 and is operably associated with downhole sampling chamber 208. Magnetic field generator 212 is operable to generate a magnetic field that is imposed upon the mixing element within downhole sampling chamber 208 causing the mixing element moves through the formation fluid sample, thereby mixing the formation fluid sample in downhole sampling chamber 208. Support stand 200 includes a control station 214 depicted as a portable computer that is operable to control parameters of the mixing operation, such as the intensity, direction, dimensions and duration of the magnetic field. For example, the generated magnetic field may create a simple liner force operable to move the mixing element longitudinally back and forth within downhole sampling chamber 208 or the generated magnetic field may create a complex three dimensional force operable to rotate the mixing element or make the mixing element travel in a spiral or other non linear path as it moves longitudinally back and forth within downhole sampling chamber 208. Control station 214 may also be operable to control the duration and intensity of the heat output of heating elements 210 and the vibration of sampling chamber receivers 204, 206. In addition, control station 214 may record and use pressure and temperature data obtained from internal sensors disposed within downhole sampling chamber 208.

Figure 4A:
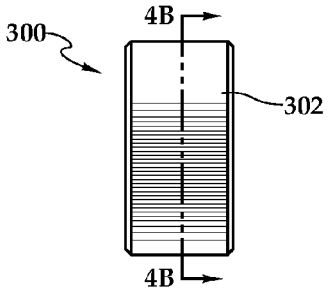
FIGS. 4A and 4B are side and cross sectional views of a mixing element for mixing a formation fluid sample obtained in a downhole sampling chamber according to an embodiment of the present invention.
Figure 4B:
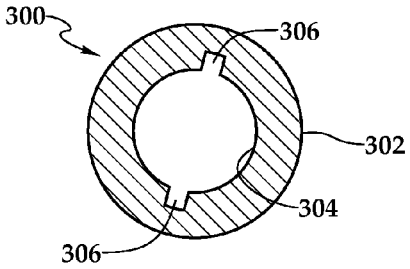

Referring now to FIGS. 4A-4B, therein is depicted a mixing element for mixing a formation fluid sample obtained in a downhole sampling chamber that is generally designated 300. Mixing element 300 is preferably formed from a metal that is responsive to the magnetic field generated by magnetic field generator 212 such that mixing element 300 will move longitudinally back and forth through the formation fluid sample in the downhole sampling chamber responsive to changes in the imposed magnetic field. Mixing element 300 has a substantially cylindrical body 302 and has a fluid passageway 304 formed substantially in the center thereof. The inner surface of fluid passageway 304 may be smooth, however, in the illustrated embodiment, the inner surface of fluid passageway 304 includes a profile 306 depicted as fluting or riffling that is spirally or helically formed therein. Profile 306 rotatably biases mixing element 300 when mixing element 300 is traveling longitudinally through a formation fluid sample in a downhole sampling chamber such that interaction with the formation fluid sample causes mixing element 300 to rotate and/or rotation of mixing element 300 causes the formation fluid sample to spin in the downhole sampling chamber. In either case, rotation of mixing element 300 aids in rapid mixing the formation fluid sample. Preferably, mixing element 300 has a relatively close fitting relationship with the inner surface of the downhole sampling chamber. The relatively close fitting relationship not only helps mixing element 300 rotate about its longitudinal axis, but also helps mixing element 300 sweep any precipitated solids off the inner surface of the downhole sampling chamber to enable recombination of such solids with the formation fluid sample.

Figure 5A:
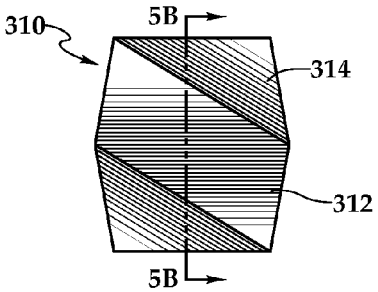
FIGS. 5A and 5B are side and cross sectional views of a mixing element for mixing a formation fluid sample obtained in a downhole sampling chamber according to an embodiment of the present invention.
Figure 5B:
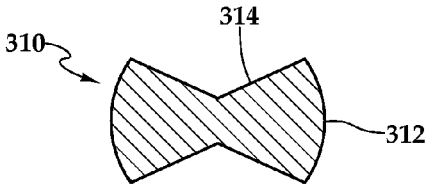

Referring next to FIGS. 5A-5B, therein is a mixing element for mixing a formation fluid sample obtained in a downhole sampling chamber that is generally designated 310. Mixing element 310 is preferably formed from a metal that is responsive to the magnetic field generated by magnetic field generator 212 such that mixing element 310 will move longitudinally back and forth through the formation fluid sample in the downhole sampling chamber responsive to changes in the imposed magnetic field. Mixing element 310 has a substantially cylindrical body 312. The outer surface of cylindrical body 312 includes a profile 314 depicted as fluting that is spirally or helically formed therein. Profile 314 rotatably biases mixing element 310 when mixing element 310 is traveling longitudinally through the formation fluid sample in the downhole sampling chamber such that interaction with the formation fluid sample causes mixing element 310 to rotate and/or rotation of mixing element 300 causes the formation fluid sample to spin in the downhole sampling chamber. In either case, rotation of mixing element 310 aids in rapid mixing the formation fluid sample. Preferably, mixing element 310 has a relatively close fitting relationship with the inner surface of the downhole sampling chamber. The relatively close fitting relationship not only helps mixing element 310 rotate about its longitudinal axis, but also helps mixing element 310 sweep any precipitated solids off the inner surface of the downhole sampling chamber to enable recombination of such solids with the formation fluid sample.

Figure 6A:
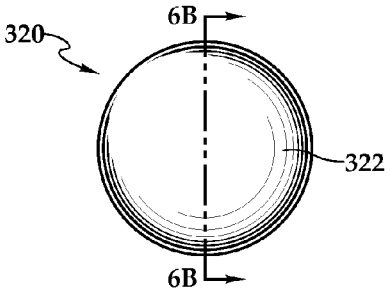
FIGS. 6A and 6B are side and cross sectional views of a mixing element for mixing a formation fluid sample obtained in a downhole sampling chamber according to an embodiment of the present invention.
Figure 6B:
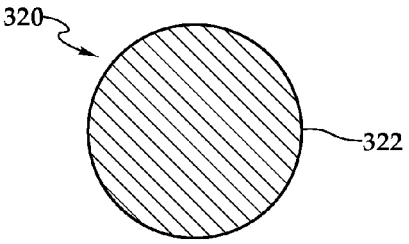

Referring next to FIGS. 6A-6B, therein is a mixing element for mixing a formation fluid sample obtained in a downhole sampling chamber that is generally designated 320. Mixing element 320 is preferably formed from a metal that is responsive to the magnetic field generated by magnetic field generator 212 such that mixing element 320 will move longitudinally back and forth through the formation fluid sample in the downhole sampling chamber responsive to changes in the imposed magnetic field. In the illustrated embodiment, mixing element 320 has a solid, spherical body 322. It should be noted, however, by those skilled in the art that mixing element 320 could alternatively include one or more fluid passageways that are smooth or profiled or could have a profiled outer surface. Preferably, mixing element 320 has a relatively close fitting relationship with the inner surface of the downhole sampling chamber. As another alternative, mixing element 320 may have a diameter that is substantially smaller than the diameter of the downhole sampling chamber. In this embodiment, it may be desirable to have more than one mixing element 320 disposed within the downhole sampling chamber.

Figure 7A:
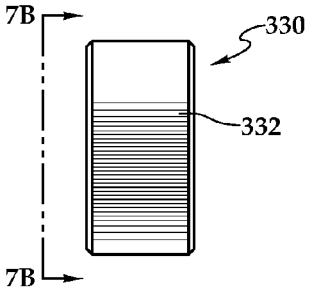
FIGS. 7A and 7B are side and front views of a mixing element for mixing a formation fluid sample obtained in a downhole sampling chamber according to an embodiment of the present invention.
Figure 7B:
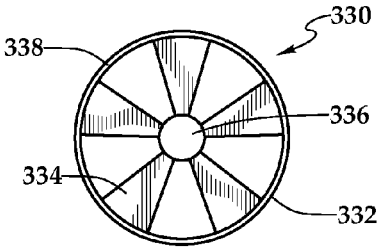

Referring next to FIGS. 7A-7B, therein is a mixing element for mixing a formation fluid sample obtained in a downhole sampling chamber that is generally designated 330. Mixing element 330 is preferably formed from a metal that is responsive to the magnetic field generated by magnetic field generator 212 such that mixing element 330 will move longitudinally back and forth through the formation fluid sample in the downhole sampling chamber responsive to changes in the imposed magnetic field. Mixing element 330 has a substantially cylindrical body 332. Mixing element 330 includes a plurality of blades 334 that are supported between inner member 336 and outer member 338. Blades 334 rotatably bias mixing element 330 when mixing element 330 is traveling longitudinally through the formation fluid sample in the downhole sampling chamber such that interaction with the formation fluid sample causes mixing element 330 to rotate and/or rotation of mixing element 330 causes the formation fluid sample to spin in the downhole sampling chamber. In either case, rotation of mixing element 330 aids in rapid mixing the formation fluid sample. Preferably, mixing element 330 has a relatively close fitting relationship with the inner surface of the downhole sampling chamber. The relatively close fitting relationship not only helps mixing element 330 rotate about its longitudinal axis, but also helps mixing element 330 sweep any precipitated solids off the inner surface of the downhole sampling chamber to enable recombination of such solids with the formation fluid sample.

Figure 8:
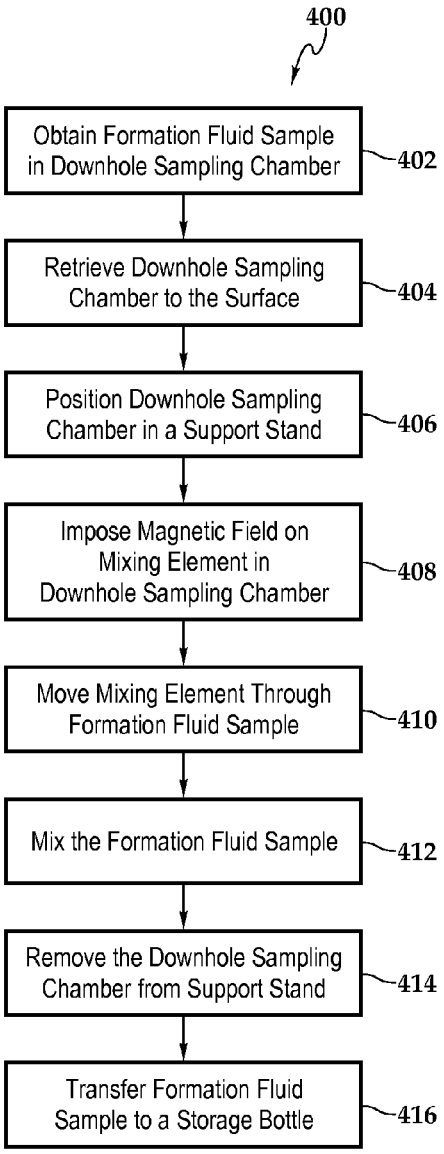
FIG. 8 is a flow diagram of a process for mixing a formation fluid sample obtained in a downhole sampling chamber according to an embodiment of the present invention.

A method (400) of mixing a formation fluid sample in a downhole sampling chamber will now be described with reference to FIG. 8. After a formation fluid sample has been obtained in a downhole sample chamber (402) and retrieved to the surface (404), the downhole sample chamber may be removed from the fluid sampler system and positioned in a support stand (406). A magnetic field generator is then operated to impose a magnetic field on a mixing element disposed in the downhole sampling chamber (408). The magnetic field causes the mixing element to move longitudinally back and forth through the formation fluid sample (410). The movement of the mixing element through the formation fluid sample is continued until the formation fluid sample is suitably mixed (412). The downhole sampling chamber may then be removed from the support stand (414) and the formation fluid sample may be transferred to a storage bottle (416). Alternatively, the formation fluid sample may be transferred to a storage bottle (416) prior to removing the downhole sampling chamber from the support stand (414).

Figure 9:
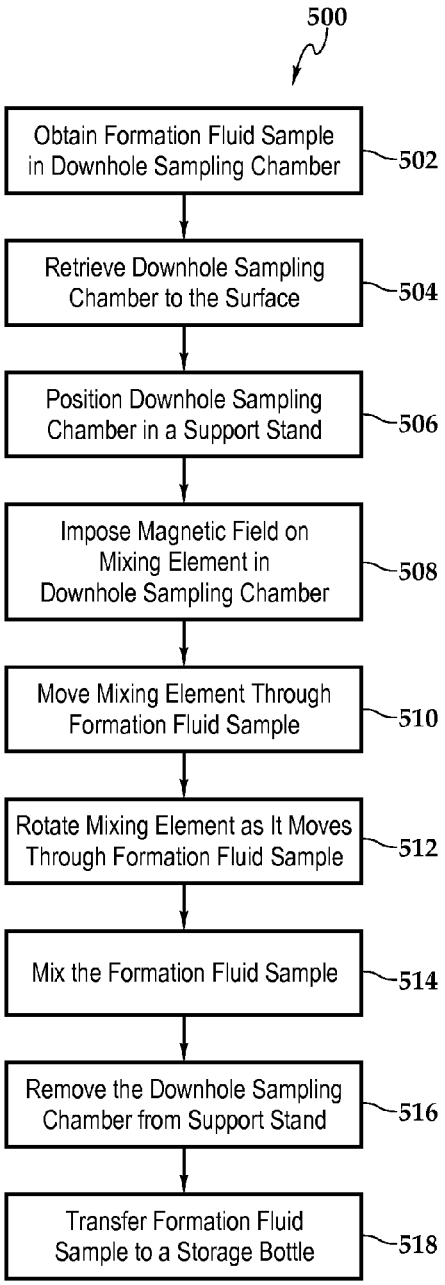
FIG. 9 is a flow diagram of a process for mixing a formation fluid sample obtained in a downhole sampling chamber according to an embodiment of the present invention.

A method (500) of mixing a formation fluid sample in a downhole sampling chamber will now be described with reference to FIG. 9. After a formation fluid sample has been obtained in a downhole sample chamber (502) and retrieved to the surface (504), the downhole sample chamber may be removed from the fluid sampler system and positioned in a support stand (506). A magnetic field generator is then operated to impose a magnetic field on a mixing element disposed in the downhole sampling chamber (508). The magnetic field causes the mixing element to move longitudinally back and forth through the formation fluid sample (510). The magnetic field or the interaction between the formation fluid sample and the mixing element causes the mixing element to rotate (512). The longitudinal movement and rotation of the mixing element is continued until the formation fluid sample is suitably mixed (514). The downhole sampling chamber may then be removed from the support stand (516) and the formation fluid sample may be transferred to a storage bottle (518). Alternatively, the formation fluid sample may be transferred to a storage bottle (518) prior to removing the downhole sampling chamber from the support stand (516).

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is therefore, intended that the appended claims encompass any such modifications or embodiments.

What is claimed is:

1. A method of mixing a formation fluid sample in a downhole sampling chamber having a longitudinal axis and a generally cylindrical inner surface, the method comprising:

running the downhole sampling chamber into a wellbore;

obtaining the formation fluid sample in the downhole sampling chamber;

retrieving the downhole sampling chamber containing the formation fluid sample from the wellbore;

positioning the downhole sampling chamber in a support stand;

imposing a magnetic field on a mixing element disposed within the downhole sampling chamber and having a close fitting relationship with the generally cylindrical inner surface of the downhole sampling chamber;

longitudinally moving the mixing element back and forth through the downhole sampling chamber responsive to the magnetic field; and mixing the formation fluid sample.

2. The method as recited in claim 1 further comprising rotating the mixing element in the formation fluid sample.

3. The method as recited in claim 2 wherein rotating the mixing element in the formation fluid sample further comprises rotating the mixing element in the formation fluid sample responsive to the magnetic field.

4. The method as recited in claim 2 wherein rotating the mixing element in the formation fluid sample further comprises rotating the mixing element in the formation fluid sample responsive to interaction with the formation fluid sample.

5. The method as recited in claim 1 further comprising heating the formation fluid sample.

6. A method of mixing a formation fluid sample in a downhole sampling chamber having a longitudinal axis and a generally cylindrical inner surface, the method comprising:

running the downhole sampling chamber into a wellbore;

obtaining the formation fluid sample in the downhole sampling chamber;

retrieving the downhole sampling chamber containing the formation fluid sample from the wellbore;

positioning the downhole sampling chamber in a support stand;

imposing a magnetic field on a mixing element disposed within the downhole sampling chamber and having a close fitting relationship with the generally cylindrical inner surface of the downhole sampling chamber;

longitudinally moving the mixing element back and forth through the downhole sampling chamber responsive to the magnetic field;

rotating the mixing element in the formation fluid sample; and mixing the formation fluid sample.

7. The method as recited in claim 6 wherein rotating the mixing element in the formation fluid sample further comprises rotating the mixing element in the formation fluid sample responsive to the magnetic field.

8. The method as recited in claim 6 wherein rotating the mixing element in the formation fluid sample further comprises rotating the mixing element in the formation fluid sample responsive to interaction with the formation fluid sample.

9. The method as recited in claim 6 further comprising heating the formation fluid sample.

10. A system for mixing a formation fluid sample in a downhole sampling chamber having a longitudinal axis and a generally cylindrical inner surface, the system comprising:

a mixing element disposed in the downhole sampling chamber, the mixing element having a close fitting relationship with the generally cylindrical inner surface of the downhole sampling chamber;

a support stand operable to receive the downhole sampling chamber; and a magnetic field generator operably associated with the downhole sampling chamber such that when the magnetic field generator generates a magnetic field, the mixing element moves longitudinally back and forth through the downhole sampling chamber responsive to the magnetic field, thereby mixing the formation fluid sample.

11. The system as recited in claim 10 further comprising a heating element operably associated with the downhole sampling chamber operable to heat the formation fluid sample.

12. The system as recited in claim 10 wherein the mixing element further comprises a spherical mixing element.

13. The system as recited in claim 10 wherein the mixing element further comprises a substantially cylindrical mixing element.

14. The system as recited in claim 10 wherein the mixing element further comprises a fluted external surface.

15. The system as recited in claim 10 wherein the mixing element further comprises an internal fluid passageway.

16. The system as recited in claim 15 wherein the internal fluid passageway further comprises a fluted internal surface.

17. The system as recited in claim 10 wherein the mixing element further comprises a plurality of blades.

* * * * *